United States Patent [19]

Gawronski et al.

[11] Patent Number: 4,837,529

[45] Date of Patent: Jun. 6, 1989

[54] MILLIMETER WAVE MICROSTRIP TO COAXIAL LINE SIDE-LAUNCH TRANSITION

[75] Inventors: Michael J. Gawronski, Minneapolis; Steven L. Palmquist; John R. Lamberg, both of Minnetonka; Rebecca A. Hart, Plymouth, all of Minn.

[73] Assignee: Honeywell, Inc., Minneapolis, Minn.

[21] Appl. No.: 172,446

[22] Filed: Mar. 24, 1988

[51] Int. Cl.[4] ..... H01P 5/08

[52] U.S. Cl. ..... 333/33; 333/260

[58] Field of Search ..... 333/33, 34, 246, 260

[56] References Cited

U.S. PATENT DOCUMENTS

| | | | |
|---|---|---|---|
| 2,983,884 | 5/1961 | Rueger | 333/33 |
| 3,245,013 | 4/1966 | Forge | 333/33 |
| 3,324,421 | 6/1967 | Fujimoto | 333/33 X |
| 3,638,148 | 1/1972 | Hallford et al. | 333/33 X |
| 4,494,083 | 1/1985 | Josefsson et al. | 333/33 |

*Primary Examiner*—Paul Gensler

*Attorney, Agent, or Firm*—Orrin M. Haugen; Thomas J. Nikolai; Frederick W. Niebuhr

[57] ABSTRACT

A side-launch transition for efficiently joining a coaxial transmission line or coaxial connector to a microstrip transmission line for operation at millimeter wave frequencies. The microstrip transmission line comprises a conductive microstrip pattern on one side of a dielectric substrate and a ground plane on the other. The conductive microstrip pattern includes a rectangular terminal pad area of a predetermined length designed to be approximately equal to the wavelength of the signal being transmitted. This pad area is integrally joined to the microstrip line. A circular iris or aperture, is formed through the ground plane and is in a centered alignment with the terminal pad on the opposite side of the substrate. A small hole extends through the center of the iris and penetrates the substrate as well as the conductive pad area. The outer shield conductor of the coaxial transmission line or the coaxial connector and the dielectric material insulating it from its center conductor are stripped back to expose a predetermined length of center conductor which is then fitted through the small hole from the ground plane side of the substrate and soldered to the conductive pad. The outer shield is likewise soldered or otherwise conductively bonded to the ground plane in the vicinity of the iris aperture.

9 Claims, 3 Drawing Sheets

MILLIMETER WAVE MICROSTRIP TO COAXIAL LINE SIDE-LAUNCH TRANSITION

BACKGROUND OF THE INVENTION

1. Field of the Invention

This invention relates generally to electronic circuitry operable at millimeter wave frequencies, and more particularly to a transition for efficiently joining a coaxial transmission line to a microstrip transmission line.

II. Discussion of the Prior Art

In applications requiring a high degree of microminiaturization, operation at millimeter wavelength frequencies allows tiny active and passive components to be employed. For example, only a small length of printed wiring may exhibit a capacitive reactance comparable to that provided by a ceramic capacitor operating at lower frequencies.

One mode of transmitting these RF signals is the so-called microstrip transmission line. It comprises a conductive strip of a relatively narrow width on one major surface of a dielectric planar substrate and a relatively wide conductive ground plane disposed on the opposite major surface of the dielectric substrate. High frequency signals in the millimeter wavelength range propagate along the surface of the microstrip line. Such microstrip transmission lines may be exposed, but oftentimes will be contained within a conductive box-like enclosure or housing to prohibit stray radiation emanating from the transmission line to deleteriously affect other components within the electronic system embodying the microstrip transmission line. Where a closed system is utilized, it is necessary to employ a feed-through to bring the transmitted signal in and out of the enclosure. Such a feed-through may typically be a length of coaxial transmission line. Even with open or uncased microstrip transmission lines, it is still necessary to provide a means for coupling the signal output from that medium to a load such as, for example, an antenna. Again, this necessitates a transition device for mating the microstrip media to the coaxial line media.

With uncased microstrip transmission lines, practice in the past has been to utilize an edge transition in which the outer conductive shield and the center insulation of the coaxial line is stripped back to expose the center conductor and then that center conductor is laid upon the microstrip conductor and a solder bond is used to join the two. Similarly, the outer solid tubular conductive shield of the coaxial line is conductively joined to the ground plane of the microstrip media, again using solder. This type of edge-launch transition is not altogether satisfactory in many applications, primarily because of packaging limitations, weakness of the joint and space considerations. For example, the physical geometry of the particular electronics package may preclude the use of an edge-launch transition between the microstrip and the coax line.

When the microstrip transmission line is contained within a conductive housing, the ground plane of the microstrip transmission line assembly can be soldered to the base or floor of the housing and, likewise, the tubular conductive shield of the coaxial line may also be soldered to the housing. This results in a stronger, more rugged construction but, as pointed out below, physical constraints of the electronic package itself may preclude this type of edge-launch transition.

For the foregoing reasons, a need exists for a more efficient means of joining a microstrip transmission line to a coaxial transmission line in a side-launch configuration. The present invention fulfills such a need. In particular, the present invention provides a means for coupling microstrip devices or systems to other transmission media, coaxial line in this case. In accordance with the present invention, a side-launch transition has been devised. To the best of our knowledge, we are the first to devise a side-launched coax to microstrip transition operable at millimeter wave frequencies. It is our belief that no one has earlier attempted a side-launch transition at millimeter wave frequencies because of the difficulty in simultaneously converting from coaxial mode to microstrip mode and in compensating for the large parasitic reactances present at millimeter wave frequencies.

OBJECTS

It is accordingly a principal object of the present invention to provide an improved method and apparatus for efficiently coupling a coaxial transmission line to a microstrip transmission line in a side-launch configuration.

Another object of the present invention is to provide a side-launch transition for applications where an edge-launch transition will not physically fit or where mechanical constraints makes it more convenient.

Still another object of the invention is to provide a side-launched transition between a coaxial transmission line and a microstrip transmission line in which attention is paid to compensating parasitic reactances.

Yet still another object of the invention is to provide a side-launched transition between a microstrip transmission line and a coaxial cable in which two approximately half wavelength matching transmission line sections are used to bisect the side-launch coaxial cable.

A yet further object of the invention is to provide a side-launched transition between a coaxial transmission line and a microstrip transmission line which is small in size and, thus, compatible with mechanical system requirements in many microminiaturized radio frequency systems.

SUMMARY OF THE INVENTION

In accordance with the present invention, the microstrip on the first side of the dielectric substrate is provided with an integrally formed, generally rectangular conductive pad area where the length of the pad is approximately equal to the wavelength of the signal being transmitted. Formed through the conductive ground plane on the other side of the substrate from the conductive pad area is a circular aperture of a predetermined diameter which is equal to or slightly less than the diameter of the coax transmission line to be joined to the microstrip transmission line. A small hole is drilled through the center of this aperture and extending through both the dielectric substrate layer and the conductive pad. This hole is dimensioned to receive the center conductor of the coaxial line. Because this geometry in a plan view resembles an eye, the aperture is referred to herein as an "iris". In that the iris formed through the ground plane is centrally aligned within the rectangular pad area, two conductive segments, each approximately one-half wavelength long, extend outwardly on either side of the coax line's center conductor when that conductor is inserted through the dielectric layer and through the microstrip conductive pad area.

Once so inserted, the coax transmission line's center conductor is conductively bonded to the conductive pad by soldering. Following that, the outer shield of the coaxial transmission line is joined to the ground plane by soldering the two together around the perimeter of the aperture.

When the microstrip transmission line is enclosed in a conductive, box-like housing having a floor surface abutting the ground plane of the microstrip transmission line, a reliable joint between the outer tubular conductor of the coaxial line and the ground plane can be achieved by boring an appropriate sized hole through the floor of the housing and then fitting the coaxial transmission line into that bore with the center conductor again extending through a small hole drilled through the microstrip assembly at the site of the iris and then soldering the exterior surface of the coaxial cable to the wall of the bore drilled through the floor of the housing. Alternatively, a coaxial connector (male or female) can be bolted to the exterior of the housing floor with the connector's dielectric extending through a predrilled hole in the housing floor so as to butt up against the substrate ground plane with its pre-etched iris. The connector's center pin then extends through a hole drilled both through the substrate and through the rectangular conductive pad area on the opposed side of the substrate. The coaxial cable can then be joined to the connector in a conventional fashion (e.g., using a mating connector).

As will be explained further hereinbelow, both of these transitions effectively match the characteristic impedance of the coaxial line to that of the microstrip line which is, of course, a condition resulting in a maximum power transfer. Furthermore, by paying particular attention to the thickness of the dielectric substrate, the diameter of the coaxial cable and the size of the iris or opening through the ground plane, it is possible to compensate the parasitic reactances present in the region where the electromagnetic fields make a 90° "bend", further minimizing power losses and reflections at the site of the transition.

DESCRIPTION OF THE DRAWINGS

These and other objects and advantages of the invention will become apparent to those skilled in the art from the following detailed description of a preferred embodiment in which.

DETAILED DESCRIPTION OF THE INVENTION

Figure 1:
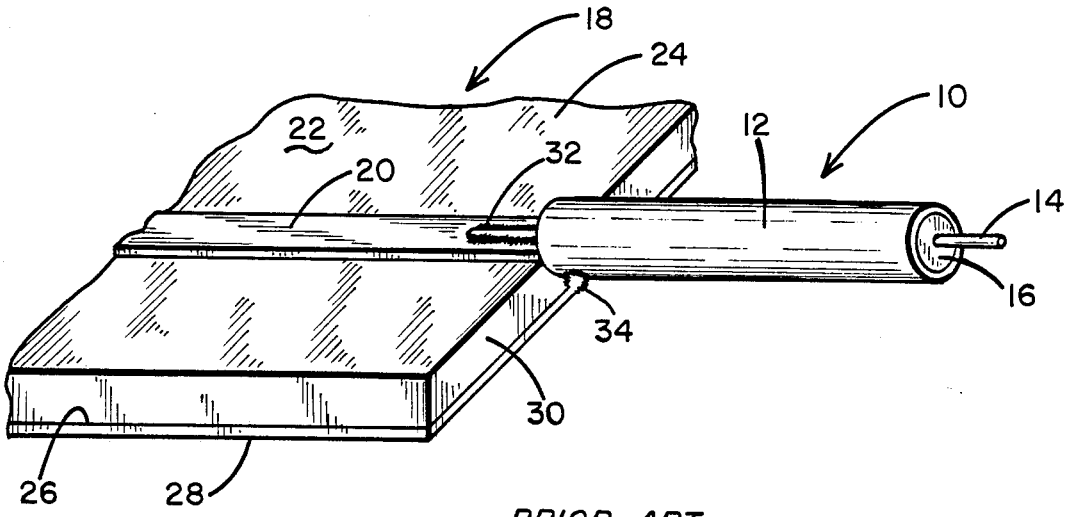
PRIOR ART Fig. 1
FIG. 1 is a perspective view of a prior art edge launched coaxial to microstrip transmission line transition.

Before going into the detailed description of the preferred embodiments, it is deemed helpful to an overall understanding of the invention to first consider the well-known prior art edge-launched transition whereby coaxial and microstrip transmission lines are joined. With reference to FIG. 1, the coaxial transmission line is identified by the numeral 10 and is entirely conventional in including an outer tubular conductive shield 12 which, typically, will be formed from a solid outer conductor and a center conductor 14 coaxially disposed within the tubular shield and spaced therefrom by a dielectric medium, such as any one of a number of available plastics. This insulating layer is identified by numeral 16.

The microstrip transmission line is indicated generally by numeral 18 and it includes a microstrip conductor 20 which is disposed on a first major surface 22 of a dielectric substrate 24. The strip 20 has a relatively narrow width dimension and of a length tailored to the particular application. On the opposite major surface 26 of the dielectric substrate 24 is a relatively wide ground plane 28. That is to say, the width of the ground plane is several times the width of the conductive microstrip 20. The conductors 20 and 28 may be defined using conventional printed circuit techniques.

As can be seen from FIG. 1 in forming the edge-launched transition, the end portion of the coaxial cable 10 is made to abut the edge surface 30 of the microstrip assembly 18 and is generally longitudinally aligned with the microstrip 20. An end portion of the outer shield 12 and the underlying dielectric 16 is stripped off to expose a predetermined length of the center conductor 14 and this exposed length is made to overlay the conductive microstrip 20. A connection is then made between the two using solder, as at 32, or other known conductive joining process. An exposed end portion of the outer conductive shield 12 is likewise joined to the ground plane 28 of the microstrip assembly as at 34 to complete the transition.

Another commercially-available edge-launched coaxial-to-microstrip transition is available through Wiltron Corporation of Mountain View, Calif. Rather than directly soldering the center conductor of the coaxial cable to the microstrip and its conductive tubular shield to the ground plane, in the Wiltron transition, the microstrip transition line is mounted within a housing having a small diameter bore and a larger diameter threaded counterbore. Fitted into the small diameter bore is a center conductor member which is supported within a glass bead. The center conductor is attached at one end to the microstrip by a conductive bond and the other end of the center conductor extends into the threaded counterbore. The counterbore is configured to receive a threaded double female plug, one end mating with the center conductor and the other end mating with a male connector to which the coaxial cable is attached.

Figure 2:
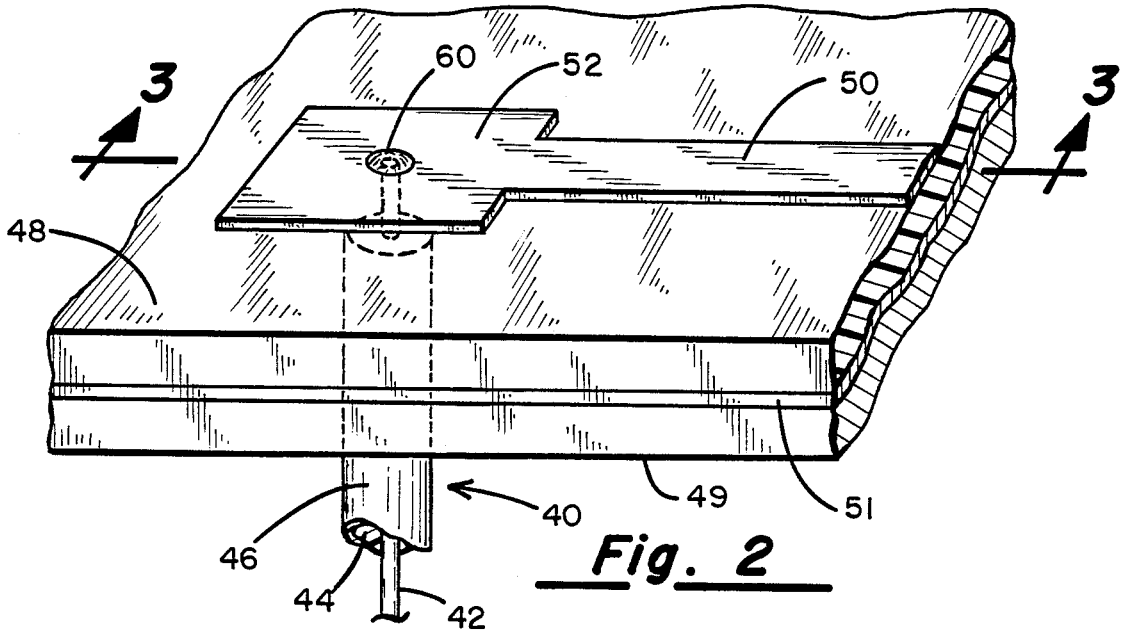
FIG. 2 is a perspective view of the side-launched transition in accordance with a first embodiment of the present invention.
Figure 3:
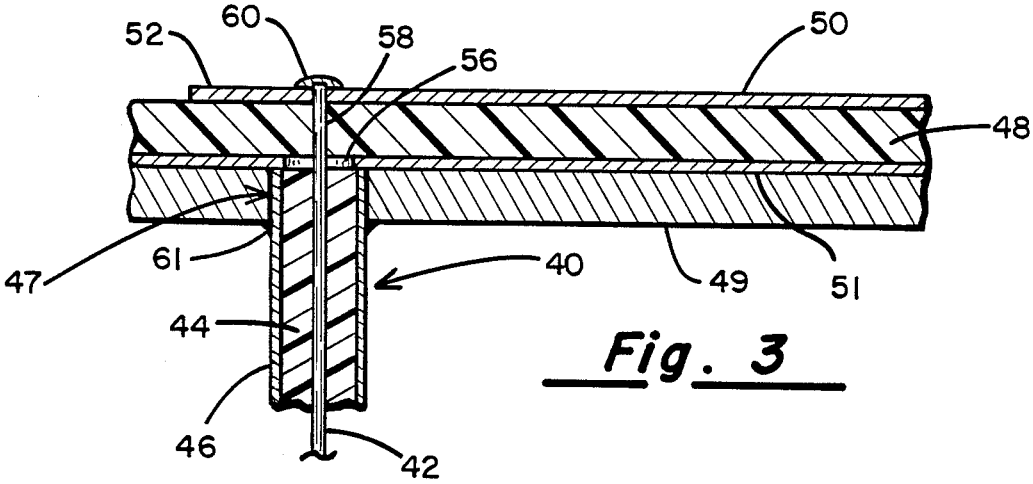
FIG. 3 is a side cross-sectional view taken along the line 3—3 in FIG. 2.

Referring now to FIGS. 2 and 3, it may be observed that the side-launch transition of the present invention again comprises a coaxial cable 40 having a center conductor 42, a surrounding cylindrical body of dielectric material 44 and an outer concentric conductive tubular sleeve 46.

The microstrip line is disposed within a conductive housing, only the base or floor of which is shown in the drawings and is identified by numeral 49. A bore 47 is formed through the floor 49 and is of a diameter slightly greater than the O.D. of the tubular shield conductor 46. The microstrip transmission line comprises an insulating substrate 48 of a predetermined thickness dimension having a microstrip conductor 50 formed on one major surface thereof and a conductive ground plane 51 formed on the opposed surface which is conductively joined to the floor 49. At the site of the transition, the microstrip line 50 widens out to form a generally rectangular conductive pad area 52. The length dimension of this conductive pad area is designed to approximately equal one wavelength of the signal with which the transmission system will be used.

With continued reference to FIGS. 2 and 3, disposed directly beneath the conductive pad area 52 and centrally disposed relative thereto is an etched circular aperture 56 which extends only through the thickness dimension of the ground plane 51. The circular aperture 56 is concentric with the bore 47 in the housing floor. The diameter of the opening 56 is generally equal to or a predetermined slight degree less than the outside diameter of the dielectric layer 44 of the coaxial transmission line. Centrally located within the aperture 56 and extending through the insulating dielectric substrate layer 48 and the thickness dimension of the conductive pad area 52 is a small drilled hole 58 whose diameter is slightly greater than the diameter of the central conductor 42 of the coaxial line 40. The coaxial line is inserted into bore 47 and an exposed end portion of the central conductor 42 of the coaxial cable is fitted upward through the hole 58 so as to project slightly above the top level of the conductive pad 52. A bead of solder 60 is then used to conductively join the center conductor of the coaxial cable to the pad area of the microstrip transmission line. Likewise, the portion of the coaxial outer conductor inserted into the bore 47 in the housing base 49 is soldered to the inside of the bore 47 to make a connection to the ground plane. The coaxial outer conductor is also soldered to the housing base 49, as at 61, for added strength.

Taking into account the geometry of the circular aperture 56 and the centrally disposed hole 58 which extends through the insulation layer and the conductive pad area, the overlaying circular patterns may conveniently be referred to as an iris. The center of this iris lies on the perpendicular bisector of the length dimension of the pad area 52 and, as such, the portions of the pad area on either side of the center of the iris are approximately each of a length $\lambda/2$. This approximately half-wave length microstrip structure on either side of the center conductor 42 acts as a pair of open circuit resonant devices which function to transform the transverse electromagnetic energy carried by the coax line to a quasi transverse electromagnetic signal carried by the microstrip transmission line and vice versa. Furthermore, the circular iris 56 etched into the ground plane 51 is used to compensate the parasitic reactances induced by the 90° change in direction of propagation and by the change from a coaxial mode to a microstrip mode. Empirical testing has revealed that the reactance of the circular iris 56 is a function of its diameter and is determined as a function of the diameter of the coaxial cable employed as well as the thickness of the microstrip's insulating substrate 48.

Figure 4:
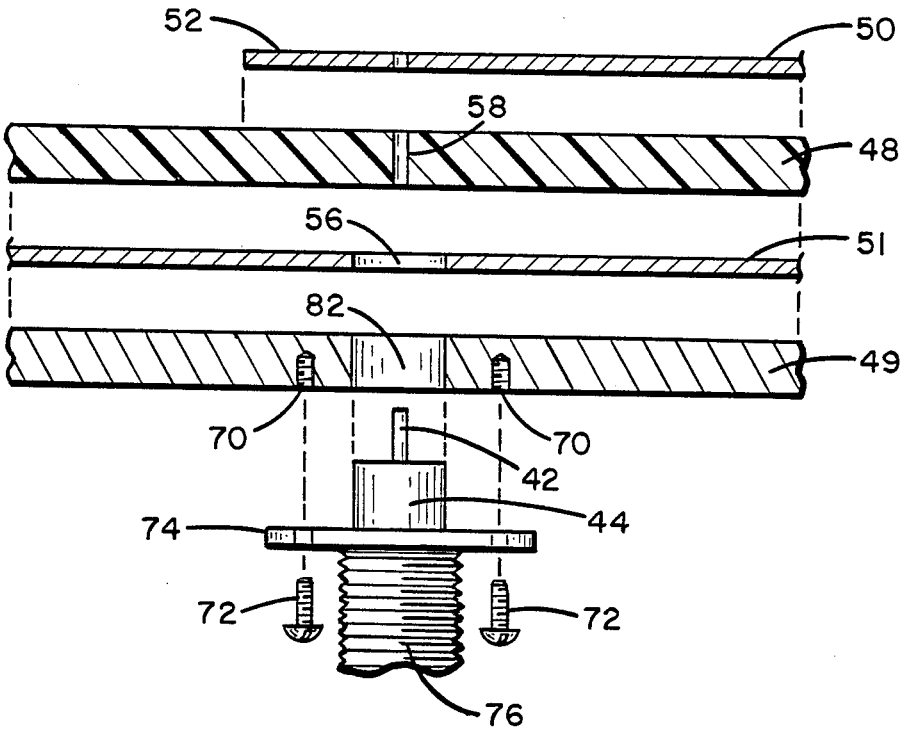
FIG. 4 is a side cross-sectional view of the side-launched transition in accordance with an alternative embodiment of the invention.

FIG. 4 illustrates an exploded side view of a side-launch microstrip to coaxial cable transition which utilizes a coaxial connector. In this arrangement, the housing floor 49 has holes as at 70 drilled into the thickness dimension thereof from the bottom and the holes are tapped to receive fasteners 72 which pass upward through a flange 74 extending laterally from the coaxial connector body 76. In this way, the coaxial cable connector body is firmly secured to the microstrip transmission line housing. The exposed dielectric cylinder 44 of the coaxial connector is trimmed to a length equal to the thickness dimension of the housing floor 49. The exposed dielectric cylinder 44 fits through the bore 82 formed through the thickness dimension of the housing floor 49 and is aligned with the iris 56 formed in the ground plane 51 when the center conductor 42 of the coaxial cable is inserted through the aperture 58. Once so assembled, the center conductor 42 may be soldered or otherwise conductively bonded to the conductive pad area 52 of the microstrip conductor as at 60 in FIGS 2 and 3.

An external thread is provided on the connector body 76 as illustrated and within the body, the central conductor has a longitudinal opening formed therein for receiving a mating pin on a cable connector (not shown) having an internally threaded ring for mating with the threads on the connector body 76 which thus serves to removably couple the two connector halves together.

Figure 5:
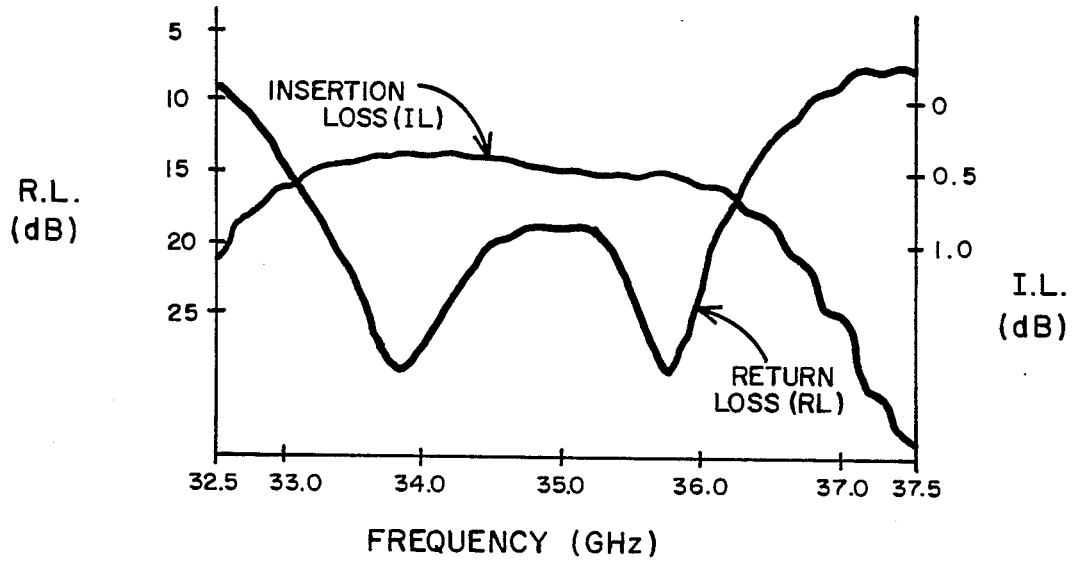
FIG. 5 are curves illustrating the performance of the present invention when compared to the prior art arrangement of FIG. 1.

The arrangement of this alternative embodiment offers the advantage of greater structural strength and ease of assembly when compared to the embodiment of FIG. 1. Thus, it is a preferred version in those applications which provide sufficient room to allow for the presence of a coaxial cable connector. To better appreciate the performance characteristics of the side-launched microstrip to coaxial cable transition, there is shown in FIG. 5 a plot of return loss and insertion loss vs. frequency for an embodiment of the type shown in FIG. 4. In the device on which the measurements shown in FIG. 5 were taken, the length of the pad 52 was 0.270 inches and its width was 0.070 inches. The width of microstrip transmission line 50 was 0.031 inches and was fabricated on 0.010 inch thick Duroid ® 5880 material manufactured by Rogers Corporation of Chandler, Ariz., using one-half ounce rolled copper. The diameter of the iris was 0.080 inches.

The curves reflect a return loss greater than 15 dB corresponding to a VSWR of 1.43:1 over a 3 GHZ bandwidth. The insertion loss is less than 0.75 dB over this same bandwidth, which is deemed to be more than adequate performance for such a transition.

Figure 6:
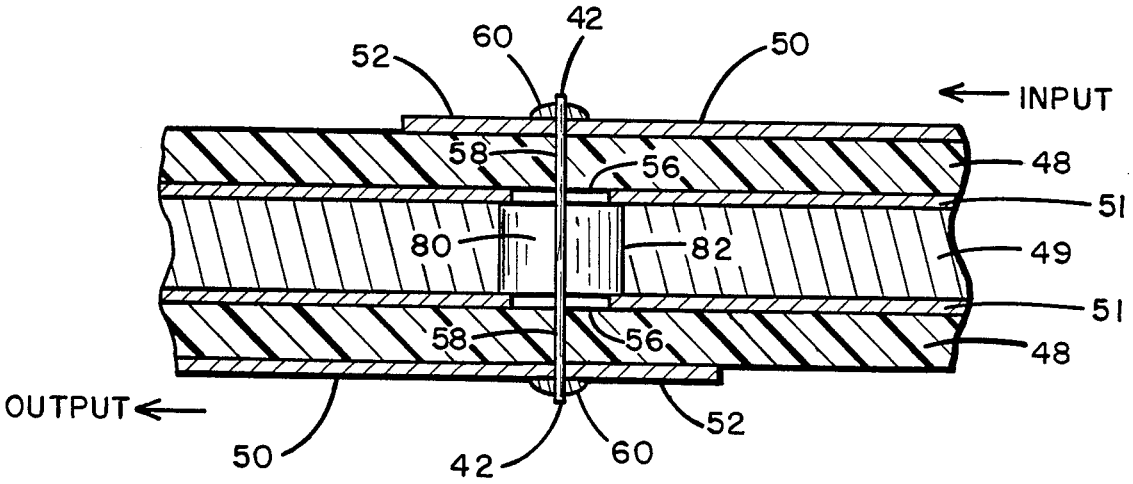
FIG. 6 shows a side-launched transition joining two microstrip transmission lines.

Referring next to FIG. 6, there is illustrated the manner in which a side-launch transition of the present invention may be from one microstrip transmission line used to feed an RF signal from one microstrip transmission line substrate to a second substrate disposed beneath it. Again, each of the microstrip transmission line assemblies includes a dielectric substrate 48 carrying a ground plane 51 on one surface thereof and a microstrip transmission line 50 having a pad area 52 formed on the opposed surface. The pad area 52 is again dimensioned to function as a resonator and includes a central opening 58 formed through the thickness dimension thereof. Etched or cut through the ground plane layer 51 and surrounding the aperture 58 is an iris 56.

With continued reference to FIG. 6, sandwiched between the two microstrip transmission line assemblies is a metal housing member 49 having a dielectric cylinder 80 inserted into a circular bore 82 formed through the thickness dimension of the housing member 49. This dielectric cylinder 80 has a dimension which is greater than that of the iris 56. The center conductor 42 passes through the drilled hole 58 formed in the microstrip transmission line assemblies and a bead of solder as at 60 is used to electrically join the center conductor 42 to the resonator pad 52. In this arrangement, then, a short length of coaxial cable is formed and used to connect the two side-launch transitions between adjacent microstrip transmission line assemblies. Thus, an input signal may be applied to the microstrip transmission line 50 on one substrate with the output being taken from the microstrip transmission line 50 on the other substrate.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and assembly procedures, can be accomplished without departing from the scope of the invention itself.

What is claimed is:

1. A method of coupling a coaxial transmission line or coaxial connector of the type having a center conductor and an outer conductive shield separated by a dielectric material to a microstrip transmission line of the type comprising a conductive microstrip disposed on one surface of a planar dielectric substrate and a conductive ground plane disposed on the opposed surface of said substrate for efficient signal transfer through the junction at millimeter wave frequencies, comprising the steps of:

(a) integrally forming a rectangular conductive pad area with said conductive microstrip on said one surface of said substrate, the length of said pad being approximately equal to the wavelength of the signals to be transmitted and the width of said pad area being greater than the width of said conductive microstrip;

(b) forming a circular aperture through said conductive ground plane, the center of said aperture being halfway along the length of said conductive pad area and the diameter of said aperture being slightly less than the outer diameter of said dielectric material of said coaxial transmission line or coaxial connector, said circular aperture configured to create a reactance for resonating with the parasitic reactance of the coaxial transmission line discontinuity at the operating millimeter wave frequency;

(c) forming a circular hole through the dielectric substrate and the microstrip conductor of said microstrip transmission line concentric with said circular aperture in said ground plane, the diameter of said circular hole being slightly greater than the diameter of said center conductor of said coaxial transmission line or coaxial connector;

(d) orienting said coaxial transmission line or coaxial connector normal to said microstrip transmission line and inserting an end portion of said center conductor through said circular hole; and (e) conductively joining said center conductor of said coaxial transmission line or coaxial connector to said conductive pad area of said microstrip and said outer conductive shield of said coaxial transmission line or coaxial connector to said conductive ground plane of said microstrip transmission line.

2. The method as in claim 1 wherein said center conductor is conductively joined to said pad area of said microstrip conductor by soldering.

3. The method as in claim 1 wherein said outer conductive shield is conductively joined to said ground plane by soldering.

4. A millimeter wave microstrip to coaxial line side-launch transition comprising:

(a) a conductive housing having a planar floor and a hole of a predetermined diameter formed through said floor;

(b) a coaxial transmission line or coaxial connector having a center conductor and a coaxially disposed conductive tubular shield separated from said center conductor by a dielectric material, said center conductor having a terminal portion extending outwardly a predetermined distance from the end of said dielectric material;

(c) a microstrip transmission line having a conductive microstrip pattern disposed on a first side of a planar dielectric substrate, said pattern including a generally rectangular pad area of a predetermined width dimension and a length approximately equal to the wavelength of the signal being transmitted, and a conductive ground plane generally co-extensive with said substrate disposed on a second side of said substrate and in conductive contact with said housing floor;

(d) a circular aperture of a diameter slightly less than the outer diameter of said dielectric material of said coaxial transmission line or coaxial connector extending through said conductive ground plane and in predetermined alignment with said conductive pad area and said hole formed through said floor;

(e) a further hole centrally disposed with respect to said circular aperture and extending through said dielectric substrate and through said conductive pad area for receiving said terminal portion of said center conductor; and (f) means for conductively joining said terminal portion of said center conductor to said conductive pad area and said conductive shield to the interior wall surface of said hole in said housing floor.

5. The side-launch transition as in claim 4 wherein said further hole is disposed in the center of said rectangular pad area.

6. The side-launch transition as in claim 4 wherein said further hole lies on a perpendicular bisector of the length dimension of said rectangular pad area.

7. The side-launch transition as in claim 4 wherein the portion of said conductive ground plane intersected by a projection of said dielectric of said coaxial transmission line introduces a reactance at the frequency of the signal being transmitted.

8. The side-launch transition as in claim 7 wherein the magnitude of said reactance is designed to resonate with the parasitic reactance of said coaxial transmission line discontinuity.

9. The side-launch transition as in claim 4 wherein said means for conductively joining is typically solder.

* * * * *